United States Patent [19]

Thomas

[11] 4,054,234

[45] Oct. 18, 1977

[54] COMBINATION GARMENT HANGER

[76] Inventor: John Thomas, 2105 Tomlinson Ave., Bronx, N.Y. 10461

[21] Appl. No.: 233,258

[22] Filed: Mar. 9, 1972

[51] Int. Cl.[2] ..... A47J 51/14

[52] U.S. Cl. ..... 223/91

[58] Field of Search ..... 223/90, 91, 93, 88, 223/96; 24/263 A, 263 LS, 263 R

[56] References Cited

U.S. PATENT DOCUMENTS

| | | | |
|---|---|---|---|
| 956,157 | 4/1910 | Parmley | 24/263 R |
| 2,370,313 | 2/1945 | Isaak | 223/88 |
| 2,492,287 | 12/1949 | Hogan | 223/93 |
| 2,511,304 | 6/1950 | Swanson | 223/91 |
| 2,522,595 | 9/1950 | Bacica | 223/91 |
| 2,889,092 | 6/1959 | Gibron | 223/91 |
| 2,924,363 | 2/1960 | Reller et al. | 223/93 |

FOREIGN PATENT DOCUMENTS

| | | | |
|---|---|---|---|
| 389,096 | 6/1908 | France | 24/263 R |

*Primary Examiner*—George H. Krizmanich

[57] ABSTRACT

This invention relates to a new and useful combination garment garment hanger and improvements thereof. The old type garment hanger supports both an upper garment such as a jacket, and a lower garment such as a pair of trousers or a skirt, but it makes no provision for preventing slippage of the lower garment from the hanger. My new garment hanger prevents slippage of the lower garment from the hanger by making use of new and improved slidably controllable horizontal garment clamps which are mounted on the horizontal crossbar of my new combination garment hanger, and with their strong non-slip grip prevent slippage of the lower garment from the hanger to the floor where it could become soiled, wrinkled or lost.

5 Claims, 21 Drawing Figures

John Thomas
INVENTOR

John Thomas
INVENTOR

COMBINATION GARMENT HANGER

A summary of the objects of my invention of a new combination garment hanger and its improvements follows:

A primary object of this invention is to provide new and useful improvements in garment hangers by adding slidably controllable horizontal garment clamps with strong non-slip grip to prevent slippage of the lower garment from the hanger to the floor where it could become soiled, wrinkled or lost.

A secondary object of this invention is to provide a combination garment hanger which is strong, good-looking, durable, reliable, efficient, economical and easy to manufacture and use.

A third object of this invention is to provide a combination garment hanger whose garment clamps are made mostly of the same material as the main frame, thus giving it the uniform appearance, be it made of plastic, rustless metal or other suitable material.

A fourth object of this invention is to provide a combination garment hanger whose garment clamps may be removed and still hold both the upper and lower garment.

A fifth object of this invention is to provide a main frame for the hanger with shoulders set at the best possible angle for supporting a jacket or the like so as to give the impression of neat, straight, sloping shoulders even when the jacket or the like is not padded at the shoulders.

A sixth object of this invention is to provide a combination garment hanger with a strong non-slip grip by means of V-shaped teeth which on the clamp finger will mesh with V-shaped grooves on the horizontal crossbar or with those on the bracket portion of the garment clamp itself.

A seventh object of this invention is to provide garment clamp fingers with a set of buttress-shaped teeth at right angles to the V-shaped teeth, so that when the garment is clamped, the buttress-shaped teeth will also grip the garment, and as the garment clamps are spread apart will stretch the garment flat against the horizontal crossbar and keep it free from wrinkles.

An eighth object of this invention is to provide a stronger non-slip grip than that obtained with V-shaped teeth by using buttress-shaped teeth set in a longitudinal direction on the clamp fingers that will mesh with buttress-shaped grooves which are longitudinal along the horizontal crossbar.

A ninth object of this invention is to provide a simple, efficient means of clamping the lower garment by using spring pressure on the clamp finger; the spring may be a torsion spring, a compression spring, an extension spring, a conical spring, a flat spring or a special shaped spring.

A tenth object of this invention is to provide a pair of garment clamps which will remain in position on the hanger until moved by hand along the horizontal crossbar; an improvement over the old type of garment clamps which uncontrollably slide along or revolve around the horizontal crossbar whenever the hanger is moved.

An eleventh object of this invention is to provide a pair of garment clamps whose clamp fingers are in line longitudinally with the horizontal crossbar rather than at right angles to it, thus the garment clamps blend into the horizontal crossbar, giving the hanger a neat, compact and uniform appearance, in addition allowing clamping of the lower garment to the hanger without wrinkling, even when folded over as in the case of a pair of trousers.

A twelfth object of this invention is to provide a combination garment hanger which occupies a minimum amount of clamping space so that when the hangers are hung adjacent to one another there will be a maximum number of hangers in a minimum amount of space.

A thirteenth object of this invention is to improve over garment clamps which grip the garment at an angle, by providing garment clamps which will grip the garment parallel to it at any thickness of garment.

Referring to the accompanying drawings.

Figure 1:
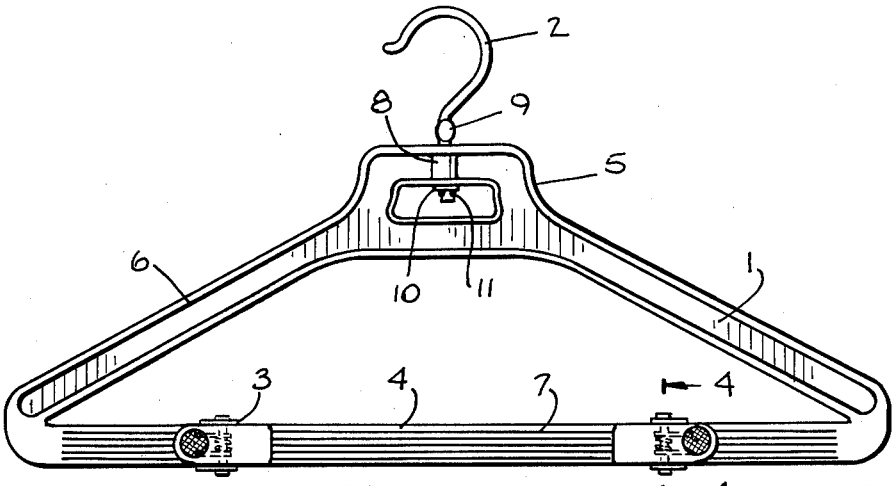
FIG. 1 shows a front elevation of the combination garment hanger.
Figure 4:
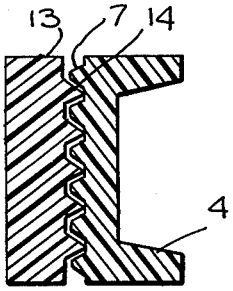
FIG. 4 shows an enlarged cross-section along line 4—4 of FIG. 1.
Figure 6:
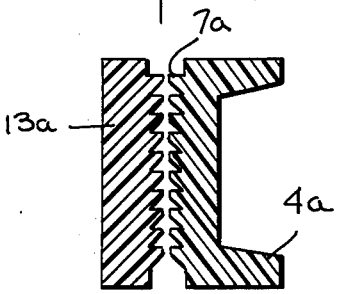
FIG. 6 shows an enlarged cross-section of a buttress-shaped tooth grip that could be used instead of the V-shaped tooth grip shown in FIG. 4.

Referring in detail to the drawings:

FIG. 1 shows a front elevation of the combination garment hanger. It is composed of a main frame 1, a swivel hook 2, and a pair of garment clamps 3. The main frame is shaped in the form of an isosceles triangle, its best base angles being 27° and 30 minutes; the apex of the triangle is a ribbed neck portion 5 integral with the ribbed shoulder portions 6, which in turn are integrally connected with the horizontal crossbar 4. The neck portions 5 and the shoulder portions 6 are made of I-beam cross-section for strength, beauty, lightness and economy. The horizontal crossbar 4 is channel-shaped in cross-section as shown in FIG. 4 and has V-shaped teeth 7 which form parallel grooves on its surface; these teeth may also be made buttress-shaped as shown in FIG. 6 to better prevent slippage. The neck portion 5 has a circular portion 8 which forms a bearing for the swivel hook 2, the latter usually being made of chrome steel and inserted through a hole drilled in the circular portion 8 after the hook has been swaged at 9; a retaining washer 10 is placed on as shown and the hook is then swaged at 11.

The hanger thus far presents a beautiful strong appearance and will enchance any suit which it supports. However, a hanger alone would allow the lower garment to slip off and become wrinkled, soiled or lost, therefore in my invention I intend to add the improvement of a pair of garment clamps mounted on the horizontal crossbar to grip the lower garment in a strong non-slip grip and prevent it from falling off the hanger.

Figure 2:
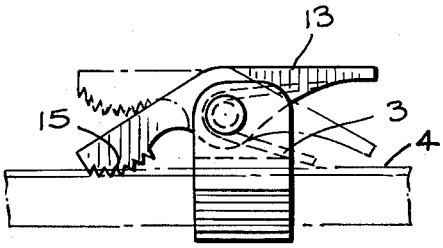
FIG. 2 shows a bottom view of the garment clamp 3 shown in FIG. 1.
Figure 3:
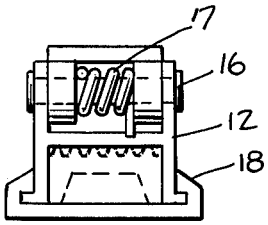
FIG. 3 shows a side elevation of FIG. 2.

Several types of garment clamps may be used. I have invented a few and will describe them; garment clamp 3 is shown in plan in FIG. 1, in elevation in FIG. 2 and in end view in FIG. 3 which shows the H-bracket 12 into which two rivet-bearing holes are drilled through the clamp finger 13, the grip end of which has V-shaped teeth 14 that mesh with grooves in the horizontal crossbar 4; at right angles to the V-shaped teeth are a set of buttress-shaped teeth 15 as shown in FIG. 2. The rivet 16 is inserted through the holes and through the torsion spring 17 and then flared. This assembly is mounted on the horizontal crossbar with the toothed section inward, the base is cemented into place, base 18 has already been slotted. Now the garment clamps will not move uncontrollably on the horizontal crossbar, they can only be moved by hand. A lower garment such as a pair of trousers may readily be clamped to the horizontal crossbar by inserting the cuff ends into the garment clamps 3, and then pulling the two garment clamps away from one another until the lower garment is stretched flat against the horizontal crossbar.

When it is desired to save trouser length space by folding the trousers over the horizontal crossbar 4, the user can prevent slippage from the hanger by clamping the thigh portions with the garment clamps, this cannot be done with vertical garment clamps and not cause wrinkling at the folded portions of the trousers.

Figure 5:
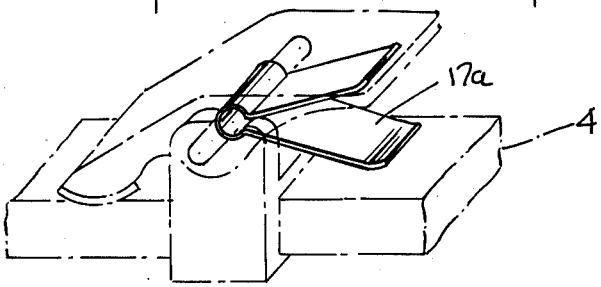
FIG. 5 shows an oblique view of a garment clamp such as clamp 3, its outline is in dot-and-dash, its flat spring is shown solid.

FIG. 5 shows an oblique view of a similar type of garment clamp in dot-and-dash outline but instead of a torsion spring 17, a special shaped flat spring **17*a*** shown in solid outline is used for simplicity and economy.

Figure 7:
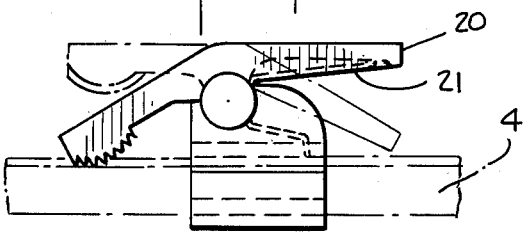
FIG. 7 shows a bottom view of a stronger garment clamp using a flat spring but no rivet.
Figure 8:
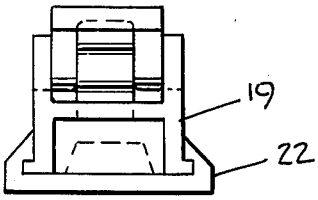
FIG. 8 shows a side view of FIG. 7.

FIGS. 7 and 8 show a stronger garment clamp. It is composed of an H-bracket 19, a clamp finger 20, and a special shaped flat spring 21; these parts are assembled and mounted on the horizontal crossbar 4, the base 22 is then cemented into place so that the garment clamp is slidable along the horizontal crossbar. The clamp finger bearing is a solid cylinder having no through rivet hole and is stronger at the central pivot section.

Figure 9:
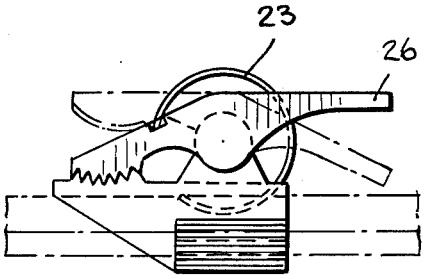
FIG. 9 shows a view of a garment clamp using a flat split-ring spring.
Figure 10:
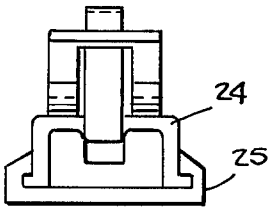
FIG. 10 shows a side view of FIG. 9.

FIGS. 9 and 10 show a strong and simple garment clamp that can be mounted on a horizontal crossbar whose shape is altered as shown to allow space for a flat split-ring spring 23 which fastens the clamp finger 26 to the slidable bracket 24, the assembly is mounted on the crossbar and base 25 is cemented in place. Note that teeth are shown on the bracket as well as on the clamp finger in order to provide a toothed grip on each side of the lower garment both by the longitudinal teeth which may be V-shaped or buttress-shaped and also by the transverse teeth which are buttress-shaped to better stretch the garment flat against the horizontal crossbar when the two garment clamps are pulled away from one another.

Figure 11:
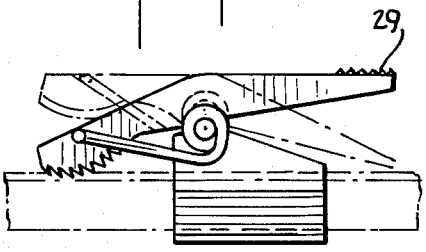
FIG. 11 shows a bottom view of a garment clamp using a torsion spring bearing.
Figure 12:
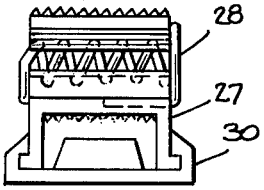
FIG. 12 shows a side view of FIG. 11.

FIGS. 11 and 12 show a garment clamp which uses a torsion spring both for bearing and for spring pressure; one end of the torsion spring 28 is fixed in the bracket 27, and the other end to the top of the clamp finger 29, the assembly is mounted on the horizontal crossbar 4, and base 30 cemented in place.

Figure 13:
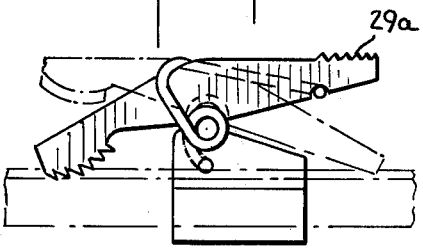
FIG. 13 shows a bottom view of a garment clamp using a torsion spring bearing in a stronger arrangement.
Figure 14:
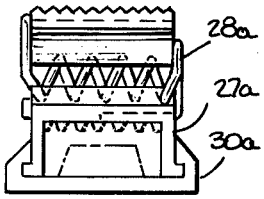
FIG. 14 shows a side view of FIG. 13.

FIGS. 13 and 14 show a garment clamp which also uses a torsion spring for both the bearing and the spring pressure but rearranged to make a stronger garment clamp than that described in FIGS. 11 and 12. It is composed of a bracket **27*a*, a torsion spring 28*a*, and a clamp finger 29*a*, all of which are mounted on the horizontal crossbar 4, the base 30*a* is cemented in place. When the operator's finger presses down on one side of the clamp finger pivot, the free end of the torsion spring presses upward on the same side almost directly under the operator's finger, thus producing practically no bending stress at the central pivot section. On the other hand, in the garment clamp of FIG. 11** the pressure is downward on both sides of the clamp finger, thus producing a double bending stress tending to rupture the clamp finger at its central pivot section.

Figure 15:
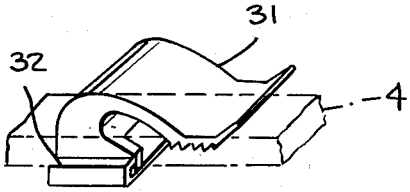
FIG. 15 shows an oblique half-size of a garment clamp that uses the elasticity of the clamp finger itself to grip the garment.

FIG. 15 shows another garment clamp in oblique half size view; it is composed of a bracket 31 whose upper portion is a curved elastic cantilever beam which, when the base 32 is cemented in place presses against the horizontal crossbar 4 so that a garment can be wedged in and gripped.

Figure 17:
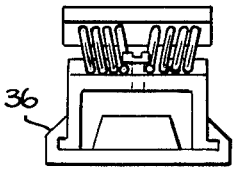
FIG. 17 shows an end view of FIG. 16.
Figure 16:
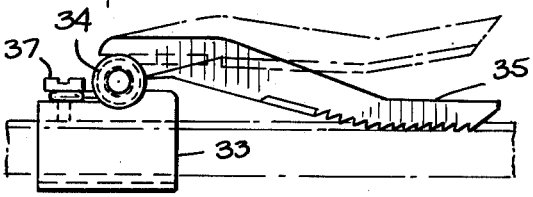
FIG. 16 shows a bottom view of a garment clamp using a double torsion spring.

FIGS. 16 and 17 show a garment clamp based on the same wedge principle as that of FIG. 15 but using a double torsion spring 34 to produce the gripping pressure. Its two free ends are pressed into the clamp finger 35, and the center of the torsion spring screwed to the bracket with screw 37, then the assembly is mounted on the horizontal crossbar 4, base 36 is cemented in place so that the operator may either wedge in the garment or lift the clamp finger and insert the garment.

Figure 18:
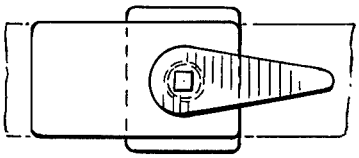
FIG. 18 shows a plan view of a garment clamp of the screw type.
Figure 19:
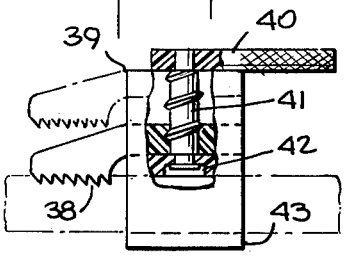
FIG. 19 shows a bottom view of FIG. 18 part sectioned.

FIGS. 18 and 19 show a garment clamp of the screw type which grips each thickness of garment with a positive parallel motion to give maximum surface grip. It is made up of a clamp finger 38 into which a clamp finger screw 41, with its attached lever 40, is screwed until the lower end of the screw projects enough to enable it to be inserted into the bracket 39 and a retaining ring 42 snapped into place. This assembly is mounted on the horizontal crossbar 4 and the base 43 cemented in place. The closed position of the clamp finger is shown solidly and the maximum open position is shown in dot-and-dash; turning the screw one way raised the clamp finger, the garment is then inserted and the screw turned in the opposite direction until the garment is sufficiently clamped to the horizontal crossbar.

Figure 20:
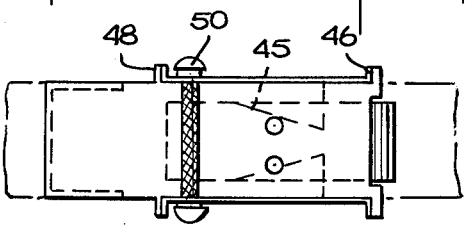
FIG. 20 shows a front elevation of a garment clamp of the buckle type which always grips parallel.
Figure 21:
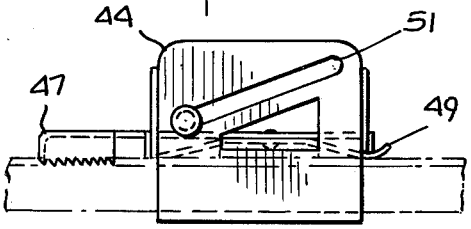
FIG. 21 shows a bottom view of FIG. 20.

FIGS. 20 and 21 show a buckle type garment clamp which also gives an up-and-down parallel motion to the clamp finger. It may be made of sheet metal bronze or the like; its U-shaped bracket 44 has been stamped and formed to fit the shape shown, two portions 45 are bent inward as shown to allow the U-bracket to slide along the horizontal crossbar 4, four bracket guides 46 are bent as shown to guide the four clamp finger bearings 48 which are on the clamp finger 47 and thus allow a parallel up-and-down motion for the clamp finger, riveted to the clamp finger is a flat spring 49 so that when the double-headed rivet 50 is drawn up the sloping slot 51 the clamp finger springs upward, the garment is then inserted, the double-headed rivet is pushed down the sloping slot and wedged against the clamp finger which then grips the garment with a strong buckle grip; the garment is released by drawing the double-headed rivet up the sloping slot.

Having described my invention I claim as patentable:

1. A garment hanger comprising a triangular frame having two opposed sloping shoulders portions, neck portions, a horizontal bar, a hook swiveled to said neck portion and a pair of spaced fingers means secured to said horizontal bar, said finger means each including a bracket slidably secured to said bar, an elongated finger attached to said bracket and means releasably engaging said fingers with said bar, said elongated fingers having their long axis in alignment with each other and parallel to said bar and forming clamps with said bar, said fingers being opposed to each other and movable toward and away from each other to clamp and hold a garment stretched therebetween.

2. A garment hanger as set out in claim 1, wherein said means for releasably engaging the fingers with said bar is a spring.

3. A garment hanger as set out in claim 1, wherein said finger is resilient forming said means for releasably engaging said fingers with said bar.

4. A garment hanger as set out in claim 1, wherein said means for releasably engaging the finger with said bar is screw threaded means.

5. A garment hanger as set out in claim 1, wherein said means for releasably engaging the finger with the bar is wedge means.

* * * * *